United States Patent [19]

Seragnoli

[11] 3,979,880

[45] Sept. 14, 1976

[54] CONTROL FOR A SYSTEM OF MACHINES FOR PROCESSING PACKETS

[75] Inventor: Enzo Seragnoli, Bologna, Italy

[73] Assignee: G. D. Societa per Azioni, Italy

[22] Filed: Mar. 17, 1975

[21] Appl. No.: 558,916

[30] Foreign Application Priority Data

Apr. 8, 1974 Italy ..... 3346/74

[52] U.S. Cl. ..... 53/77

[51] Int. Cl.[2] ..... B65B 57/00

[58] Field of Search ..... 53/77

[56] References Cited

UNITED STATES PATENTS

| | | | |
|---|---|---|---|
| 3,688,467 | 9/1972 | Alexander et al. | 53/77 |
| 3,732,664 | 5/1973 | Blossom et al. | 53/77 X |

*Primary Examiner*—Travis S. McGehee
*Attorney, Agent, or Firm*—Robert E. Burns; Emmanuel J. Lobato; Bruce L. Adams

[57] ABSTRACT

Control for a system of machines for packeting, overwrapping and parcelling packets of cigarettes or similar articles of prismatic shape, so that in the event of a machine dropping out of operation, the operator be able to set it going again after having first overcome the causes that brought about the stoppage. The control is effected through a main multiple contact remote contactor connected to the individual motors of the individual machines. The excitation coil of the remote contactor is connected in series with the operating coil of a main relay actuated by a manual pushbutton which serves to manually reset the plant in operation after an outage.

5 Claims, 3 Drawing Figures

CONTROL FOR A SYSTEM OF MACHINES FOR PROCESSING PACKETS

BACKGROUND OF THE INVENTION

This invention relates to plants for the processing of packets of cigarettes, pieces of soap or similar articles essentially of prismatic shape and, in particular, has as its subject electrical control and follow up gear for such plants.

DESCRIPTION OF THE PRIOR ART

The processing of packets of cigarettes or similar articles essentially of prismatic shape requires, as is known, machines for packeting the product, commonly called "packeting machines"; machines for overwrapping the packet containing the products, commonly called "overwrapping machines" or "cellophaning machines" since the overwrap is usually executed with a transparent material such as cellophane or with some other similar transparent material; and machines for forming a given number of overwrapped packets into cartons or parcels, commonly called "parcelling machines".

It is known to be easier to perform the operations of overwrapping the individual packets and of forming the parcels containing a number of the overwrapped packets than to carry out the operations pertinent to the formation of the individual packets. Thus the overwrapping or cellophaning machines, as well as the parcelling machines normally used in these plants for processing packets of cigarettes or similar articles essentially of prismatic shape, operate at a unit output speed greater than that of the packeting machines, and in each plant more than one packeting machine works in conjunction with one single overwrapping machine and with one single parcelling machine.

In order to render the individual packeting machines functionally independent of the overwrapping or cellophaning machine and of the parcelling machine relevant thereto a storage device or magazine is usually connected between the exits of the packeting machines and the entry point to the overwrapping or cellophaning machine. The purpose is to accumulate articles coming from the packeting machines and to supply the accumulated articles to the overwrapping or cellophaning machine at a rhythm compatible with the handling possibilities of the latter machine and with the output or infeed speed of the packeting machines. This is in conformity with the contents of U.S. Pat. No. 3,450,246 of the assignees hereof.

According to the aforementioned Patent, a multiple contact remote contactor connected to the mechanism for controlling the operational functions of the processing machines attends to the task of setting their handling rhythm to suit the running speed of the processing machines.

It is a known fact that in all production fields where a number of processing machines run in series, the second stage machines are always more prone to encountering operating problems than those with which the initial processing operations are carried out. This is because faults build up as the sequence of processing operations is gradually performed on the individual products. This obviously also happens in the plants for processing packets of cigarettes or similar articles essentially of prismatic shape. Thus the second stage machines provided, which in this particular case are the overwrapping machines and the parcelling machines, need to be fitted with a larger number of devices for controlling their various drive mechanisms prior to, during and after their respective periods of operation.

Drive mechanisms for these machines are normally provided with control devices, each of which generally consists of at least one electric contact movable in such a way that when a fault occurs or some difficulty is encountered, the processing machine to which the drive mechanism belongs is halted.

The moving contacts of the control device of the drive mechanisms are, furthermore, usually connected in series to one another so that when the fault or problem has been put right, normal operation can immediately be resumed.

This known technique satisfactorily answers the requirements for the running of the plant in accordance with the procedure outlined above. However, operational exigencies, connected above all with reliability and other guarantees make it desirable that, once the fault has been removed, or the difficulty overcome, the operator can restore operation of the machine previously halted because of the fault or difficulty.

SUMMARY OF THE INVENTION

The object of the present invention is, therefore, to make available electrical control and follow up gear in plants for processing packets of cigarettes or similar articles essentially of prismatic shape, with which the operator is able to put back into service the processing machines, once the causes of a stoppage have been remedied.

This is achieved by providing such a plant (in which there are one or more packeting machines, an overwrapping machine, a parcelling machine connected to the latter, a storage device or magazine interposed between the packeting machines and the overwrapping machine, a main multiple contact remote contactor connected to the individual electric motors used to power the packeting machines and the overwrapping machine through motor protection contactors and which also controls the satisfactory operation of the storage device or magazine, as well as a plurality of mechanisms in the overwrapping machine and the parcelling machine) with control switches interconnected in series, there being an operating relay provided with at least one moving contact and a manually operated pushbutton contact electrically connected in series to the moving contact of the relay, the operating coil of the relay being electrically shunt connected to the electrical connection between the moving relay contact and the manually operated pushbutton contact and being connected in series with the operating coil of the main multiple contact remote contactor through a pair of contacts belonging to the main multiple contact remote contactor, one of the contacts in the pair of contacts being normally open and the other, normally closed.

BRIEF DESCRIPTION OF THE DRAWINGS

Further characteristics and advantages will emerge more clearly from the following detailed description of a preferred but not the sole form of embodiment for the electrical control and follow up gear according to the invention. In the drawings

DESCRIPTION OF THE PREFERRED EMBODIMENT

Figure 1:
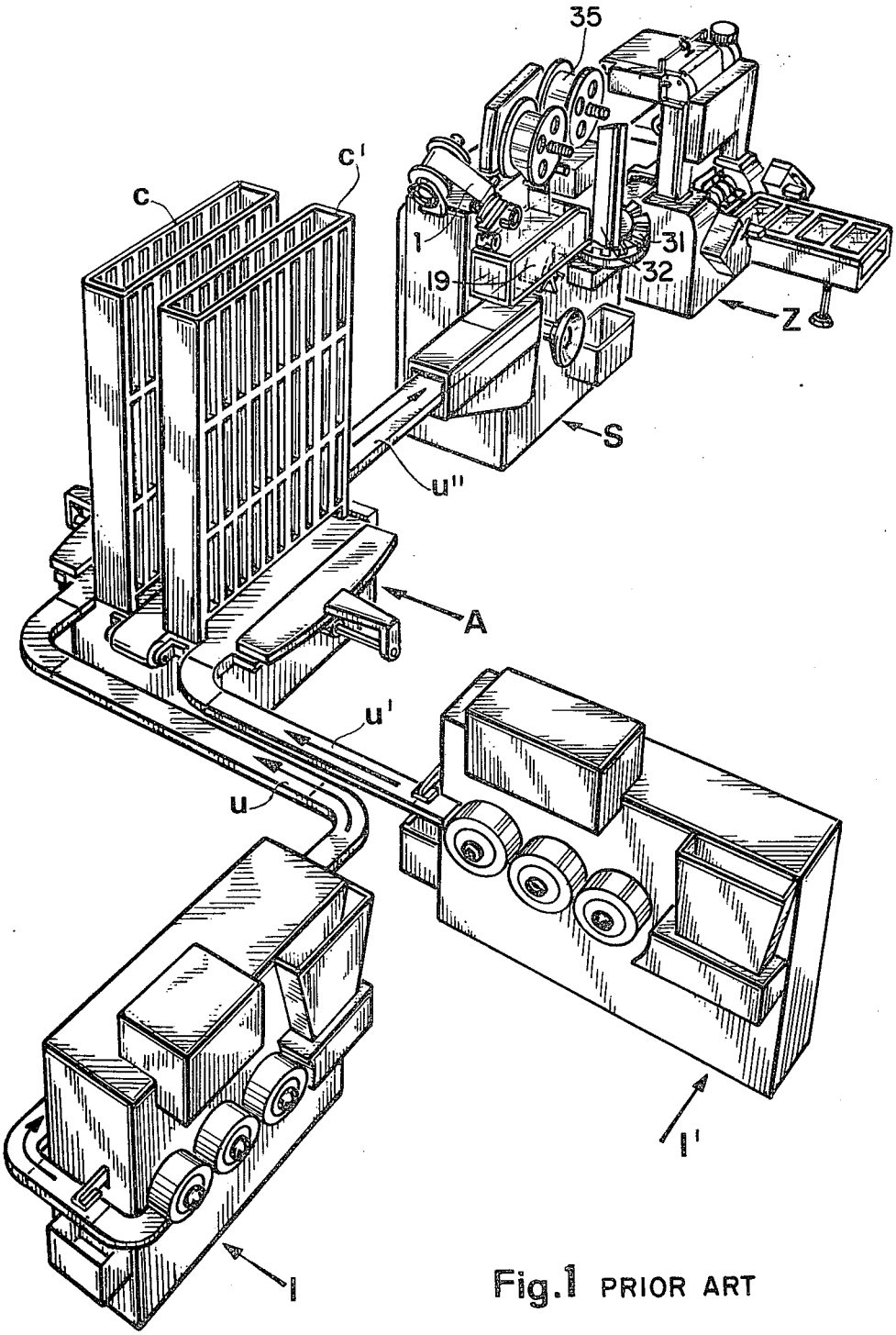
Fig.1 PRIOR ART
FIG. 1 shows, in a perspective view, a conventional plant for processing packets of cigarettes.

As shown in FIG. 1 a conventional plant for processing packets of cigarettes has two packeting machines I and I', the output channels *u* and *u'* of which supply the packets of cigarettes to a vertical storage device or magazine A, for example, of the type described in the aforementioned Patent.

Magazine A is of the type that has two stacking columns C and C', respectively, one for the packeting machine I and one for the packeting machine I', and an output channel *u''* for supplying the packets of cigarettes to the overwrapping machine S, to which the parcelling machine Z is directly coupled.

Figure 2:
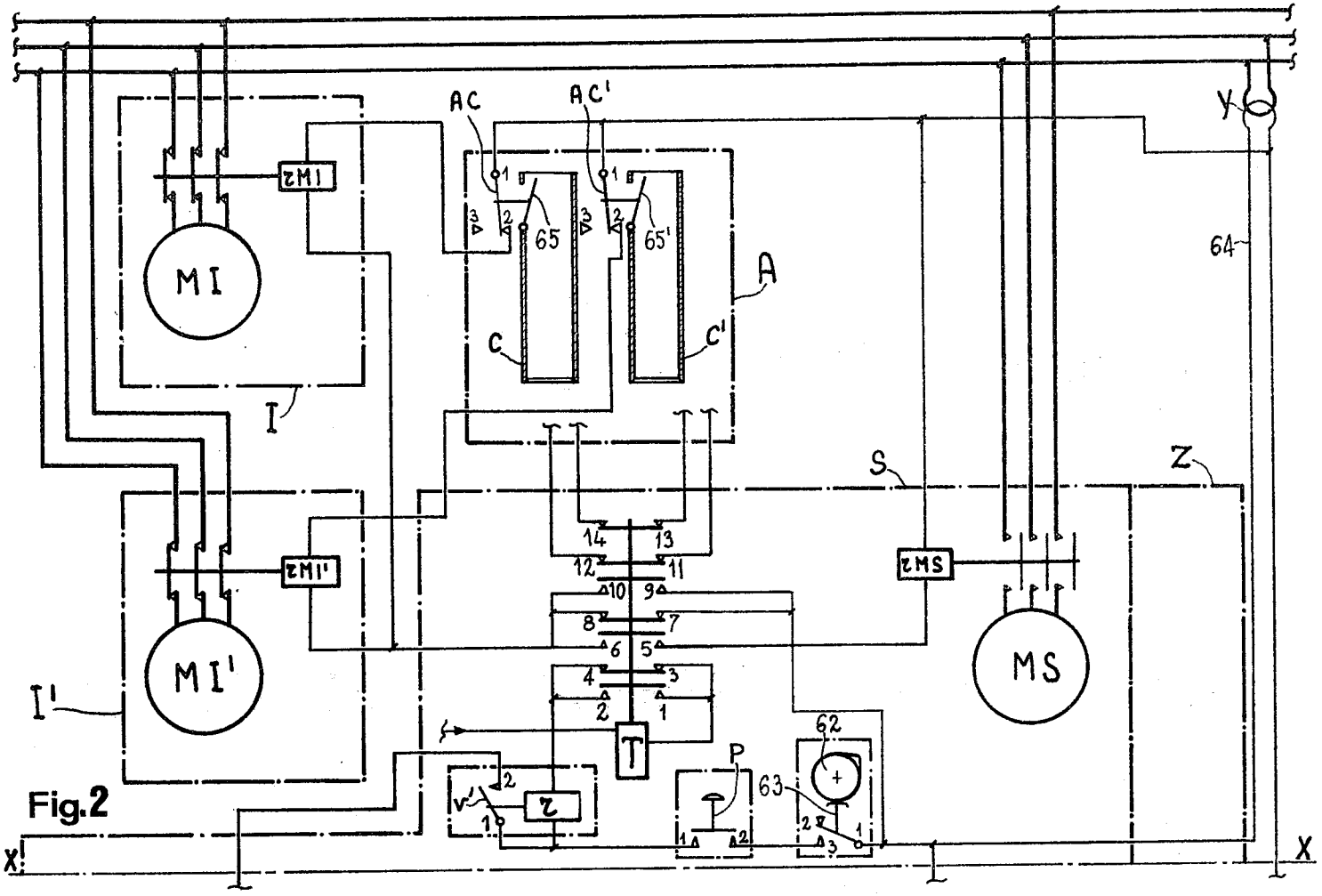
FIGS. 2 and 2*a*, to be joined along the line x—x, provide the wiring diagram for the plant, according to the invention.
Figure 2A:
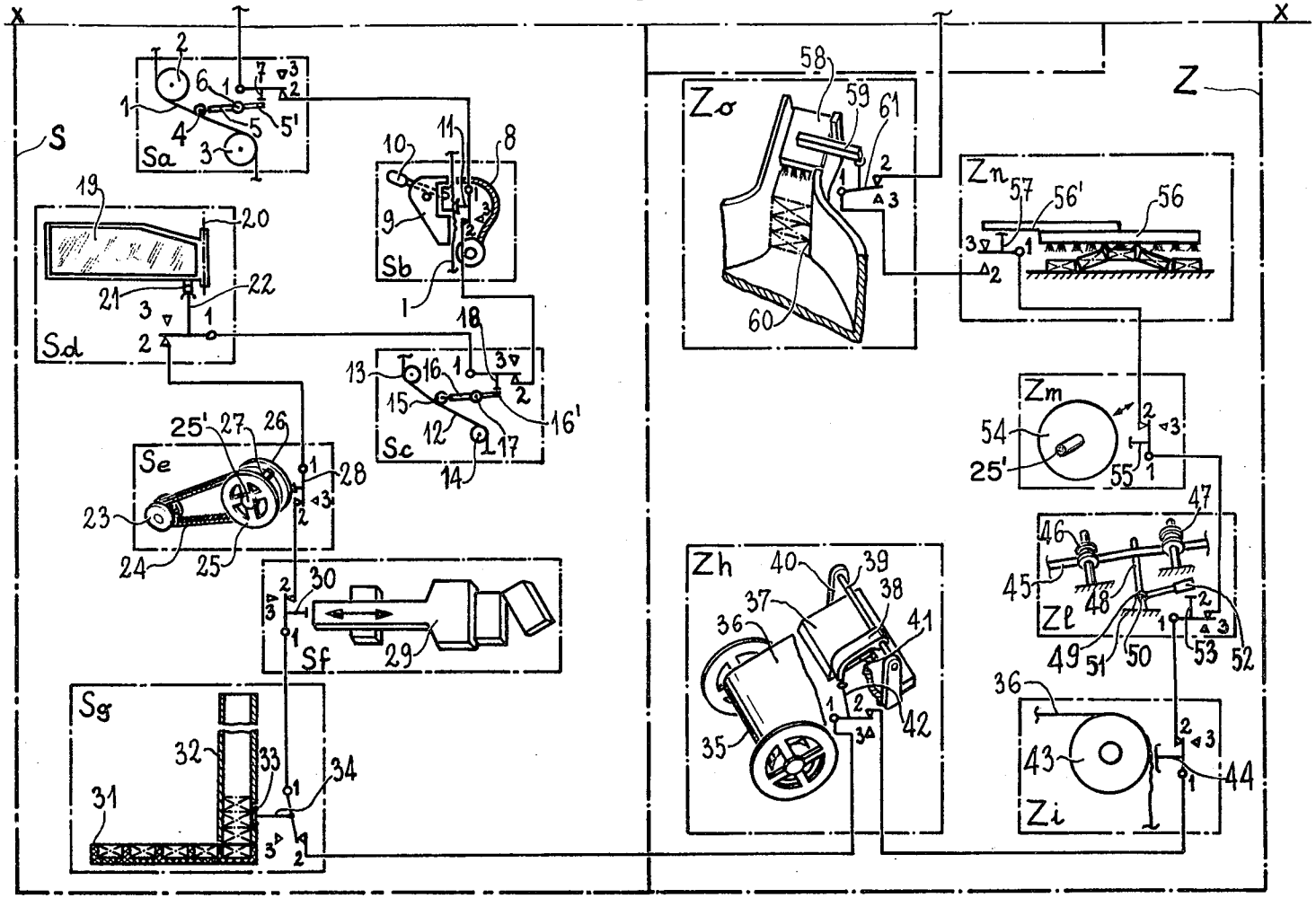

In the wiring diagrams shown by way of an example in FIGS. 2 and 2*a*, the machines I, I', S and Z, like the device A, are depicted in block form with a thin line consisting of dots and dashes delimitating each.

The sole parts of the packeting machines I and I' visible are their electric drive motors MI and MI' along with their motor protection contactors *r* MI and *r* MI', the contacts of which are normally connected to the corresponding power supply lines to normally activate these motors.

In magazine A, each stacking column C and C' has a corresponding overflow microswitch AC and AC', respectively.

For the overwrapping machine S, its electric drive motor MS is shown along with the motor protection contactor *r* MS normally dis-connected thereto, whose contacts are connected from the power supply line, as shown, to normally deactivate this motor.

Connected to the packeting and overwrapping mahines I, I' and S there is a main contactor T which has contacts 5–6, 7–8 and 9–10 for controlling, through motor protection contactors *r* MI, *r* MI' and r MS the motors MI, MI'' and MS. The main contactor T also governs the operation of the storage device A. This main contactor T is depicted, by way of an example, as having seven pairs of contacts T1–T2, T3–T4, T5–T6, T7–T8, T9–T10, T11–T12 and T13–T14. The normally open pair T1–T2 serves to keep the coil of contactor T self-excited through a plurality of microswitches connected to mechanisms of the overwrapping machine S and the parcelling machine Z, as will be seen better in due course. The normally closed pairs T11–T12 and T13–T14 are a part of the follow up contacts of the storage device or magazine A, other details of which are described in the aforementioned Patent. The normally open pairs T5–T6 and T9–T10 serve to keep drive motors Mi, Mi', M4 operating so long as the contactor T is energized.

The mechanisms with which the overwrapping machine S is provided comprise assemblies a and b for supplying from a reel, in known fashion, a strip of material 1 such as cellophane or a similar transparent material, in sheet form for wrapping around the outside of the individual packets. In FIG. 2*a* the assemblies *a*, *b* of machine S' are shown as S*a*, S*b*, respectively; similarly other assemblies *c* to *o* are shown with suitable prefixes. The machine S also has an assembly *c* for supplying, again from a reel, what is known as the "tear strip" 12 incorporated in the wrap formed around the outside of the individual packets. It also has an assembly *d* which, as will be seen better later on in this text, serves as a movable protection guard; an assembly *e* connected to the means that operate the machine itself; an assembly *f* for supplying the individual packets to the machine; and, finally, an assembly *g* for the supplementary supply of packets to replace others previously rejected.

The parcelling machine Z has assemblies *h* and *i* for supplying from a reel 35, material 36 in sheet form with which to parcel up a given number of overwrapped packets; an assembly *l* for supplying, again for a reel, what is known as the "tear strip" 45 incorporated in the material used to parcel up the packets; an assembly *m* connected to the means that operate the machine itself; an assembly *n* for checking the position of the overwrapped packets at the time they are being supplied for the formation of the parcel; and, finally, an assembly *o* for checking the number of overwrapped packets that go to make up the parcel.

In the assembly *a*, the strip 1 of cellophane or other similar transparent overwrapping material to be supplied passes between two rollers 2 and 3. Resting, in order to act as a feeler, on that part of the strip 1 located between the said rollers 2 and 3, there is a cylindrical member 4 carried loosely on one end of a lever 5 pivotally mounted to oscillate around a pin 6, the other extremity 5' of which works in conjunction with the mechanism for tripping a microswitch 7 provided with a moving contact 1 and two fixed changeover contacts 2–3. Should there be a break in the supply of the strip of material 1 from the reel, or should the reel come to an end, the lever 5 rotates around the pivot 6 and its tail end 5' is carried into a position whereby it touches the tripping mechanism of the microswitch 7 which causes the moving contact 1 to move from its normal position 1–2 to position 1–3.

The strip 1 is, furthermore, made to pass into the assembly *b*, between the fixed guide 8 and the movable guide 9, so as to adopt an operating position as shown in FIG. 2*a* in which it is held firm by a clamp bar 10 which can be operated manually or else to adopt a non-operative position. The strip 1 thus passes between the guides 8 and 9, and should it accidentally corrugate while the machine is in motion, it touches against the tripping mechanism of a microswitch 11 whose moving contact 1 then changes from its normal position 1–2 to the position 1–3.

The tear strip 12 supplied in the assembly *c* passes between two rollers 13 and 14. Resting, in order to act as a feeler, on that part of the tear strip 12 located between the rollers 13 and 14, there is a cylindrical member 15 carried loosely on one end of a lever 16 pivotally mounted to oscillate around a pin 17, the other extremity 16' of which works in conjunction with the mechanism for tripping a microswitch 18 provided with a moving contact 1 and two fixed changeover contacts 2–3. Should there be a break in the supply of the tear strip 12 from the supply reel thereof, or should the reel come to an end, the lever 16 rotates around the pivot 17 and its tail end 16' is carried into a position whereby it touches the tripping mechanism of the microswitch 18 which causes the moving contact 1 to move from its normal position 1–2 to position 1–3.

The assembly *d* consists essentially of a panel 19 rotatably mounted on hinges 20 in front of a compartment for assembly *a*, *b* and/or *c*. The panel is made of a transparent material and it serves as a guard for the front part of the machine. When, for any reason at all connected with the operation of the machine, the operator opens the panel, a feeler member 21 integral with the panel operates the tripping mechanism of a microswitch 22 which causes the moving contact 1 to move from its normal position 1–2 to position 1–3.

The assembly *e* belonging to the overwrapping machine comprises a drive pulley 23 which, through a belt 24, drives a speed reduction pulley 25, to the shaft of which is keyed, so that it can slide elastically in an axial direction, a transmission gear 26. The gear 26 is rotatably mated with the pulley 25 through a drive pin 27. In the event of an accidental increase in the torque between the pulley 25 and the gear 26, due, for example, to a blockage on the part of the packets, the gear 26 is displaced axially, against an elastic action, in such a way as to touch the tripping mechanism of a microswitch 28 which causes the moving contact 1 thereof to move from its normal position 1–2 to position 1–3.

The assembly *f* comprises a pusher member 29 which, in the event of the individual packets being fed to the overwrapping machine S causing a blockage, touches the tripping mechanism of a microswitch 30 which causes its moving contact 1 to move from its normal position 1–2 to position 1–3.

The assembly *g* is provided to supply replacement packets if there are rejects in the packets being supplied for the formation of a parcel. A rotatable feeder plate 31 passes beneath a supplementary chute 32 and in the event that faulty packets have been rejected, plate 31 drags packets dropped from chute 31 into the places where packets are missing. The hopper 32 is provided with a feeler device 33 for detecting the presence of packets within the chute.

This feeler device works in conjunction with the tripping mechanism of a microswitch 34. If the chute is empty the microswitch 34 is made to trip and this causes its moving contact 1 to move from its normal position 1–2 to position 1–3.

The assembly *h* provided to supply carton material with which to parcel up a given number of overwrapped packets comprises a reel 35 from which a parcelling strip 36 of such material is made to pass over a surface 37 below a feeler device 38 which oscillates around a shaft 39 carried by supports 40 secured to the surface 37. In this surface there is a recess 41 into which the feeler member 38 drops in the event of an interruption in the infeed of the strip 36 or of its coming to an end. In this way the feeler device brings about the tripping of a microswitch 42 which causes the moving contact 1 of the latter to move from its normal position 1–2 to position 1–3.

The strip of material 36 is, furthermore, made to pass into the assembly *i*, between a roller 43 and the tripping mechanism of a microswitch 44. If it should happen that the strip 36 accidentally corrugates, the tripping mechanism of the microswitch 44 is displaced and thus the moving contact 1 of the microswitch moves from its normal position 1–2 to position 1–3.

A tear strip 45 for the carton or parcel, in the assembly *l*, passes between two rollers 46 and 47. Resting, in order to act as a feeler, on that part of the tear strip located between the rollers 46 and 47, there is an arm 48 of a member 49 with two arms, which member is rotatably mounted so that it oscillates around a pin 50 carried by a fixed support 51.

The other arm 52 of the member 49 works in conjunction with the mechanism for tripping a microswitch 53 provided with a moving contact 1 and two fixed changeover contacts 2–3. Should there be a break in the supply of the tear strip 45 from the supply reel thereof or should that reel come to an end, the oscillating member 49 rotates around the pivot 50 and its arm 52 is carried into a position whereby it touches the tripping mechanism of the microswitch 53 which causes is moving contact 1 to move from its normal position 1–2 to position 1–3.

The assembly *m* on the parcelling machine Z takes its drive from the aforementioned drive pulley 23 of the overwrapping machine S. For this purpose the shaft 25' of the corresponding reduction pulley 25 (not depicted in FIG. 1) has a transmission gear 54 provided similarly to the transmission gear 26 previously described for the assembly *e*.

In the event of an accidental increase in the torque between reduction pulley 25 and the gear 54, due, for example, to blockage of packets supplied for the formation and wrapping of a parcel, the gear 54 is displaced axially, against an elastic action, in such a way as to touch the tripping mechanism of a microswitch 55 which causes the moving contact 1 of the microswitch 55 to move from its normal position 1–2 to position 1–3.

The assembly *n* comprises a brush device 56 for checking the position of the overwrapped packets while they are being infed for the formation of the parcel.

One part of the brush device 56 is in the form of a tail 56' and this is intended to work in conjunction with the tripping mechanism of a microswitch 57 provided with a moving contact 1 and two fixed changeover contacts 2–3. In the event of the packets infed getting blocked, the brush device 56 is raised as shown in FIG. 2*a* and the tail 56' releases the tripping mechanism of the microswitch 57, the moving contact 1 of which moves from its normal position 1–2 to position 1–3.

The assembly *o* provided to check the number of overwrapped packets destined to form the parcel, comprises a brush device 58 provided with a lateral protrusion 59.

Should there be less than the predetermined number of packets required to form the parcel, that is to say, should, for example, a packet be missing in the infeed channel 60, the brush device 58 is lowered and its protrusion 59 comes into contact with the tripping mechanism of a microswitch 61 which causes its moving contact 1 to move from its normal position 1–2 to position 1–3.

Finally, at 62 there is a cam driven by overwrapping machine motor MS (FIG. 2) to cyclically cause a microswitch 63 to be tripped and its moving contact 1 to move from its normal position 1–2 to position 1–3; at *r* there is a relay provided with a normally open moving contact *r'*; and on a line 64 shunted from a 24 V supply transformer Y, a manually operated microswitch P with normally open contacts 1–2 is connected in series with the microswitch 63 and with the operating coil of the aforementioned relay *r*.

As can be seen from the electro-mechanical diagram in FIGS. 2 and 2*a*, the microswitches of the above mentioned assemblies *a* to *o* are all interconnected in series with one another and with the moving contact *r'* of the relay *r*, the operating coil of the relay *r*, and the contacts T1–T2 and T3–T4 of the contactor T, the latter being paralleled with each other.

As previously stated, the storage device A comprises two vertical columns C and C'. Each of the columns is connected to a feeler device, 65 and 65', respectively, which work in conjunction with a corresponding microswitch, AC and AC', respectively, provided with a moving contact 1 and two fixed changeover contacts 2–3.

These feeler devices are provided to signal the filling of the storage columns. Once the level of the packets contained therein has reached the height of the corresponding feeler device, through the microswitch with which the feeler device works, the respective packeting machine I or I' is halted.

The operation of the plant with the electrical control and follow up gear in question takes place in the following way:

When the overwrapping machine S has been set ready to operate by manually depressing the pushbutton of the microswitch P, then, in phase with the closing of the microswitch 63 by the cyclic cam 62, the contactor T and the relay *r* are excited. Through the contacts T1–T2 and *r*1, respectively, they thereafter remain self-excited, as will be clear from FIG. 2. All the series connected microswitches of the assemblies *a* to *o* are closed under normal operating conditions of these assemblies (see FIG. 2*a*), just as is true, after depression of pushbutton P, as to the contact *r*1 of the relay *r* which is also connected in series with them (see FIG. 2).

Should any of the accidental conditions described with reference to the assemblies *a* to *o* occur, the contactor T and the relay *r* are de-energized through the opening of the corresponding miroswitch and thus the overwrapping machine S and, consequently, also the parcelling machine Z mechanically coupled therewith come to a halt. At the same time through the contacts T11–T12 and T13–T14 of the contactor T, the storage device A is put into service; it then operates in the way described in the above mentioned Patent.

Storage device A then stores packets at C or C', and if the overwrapping machine S continues to be out of operation, the stored packets rise to the level of the feeler device 65 or 65', the corresponding microswitch AC or AC' is tripped, and thus the displacement of its moving contact from position 1–2 to position 1–3 also causes the respective packeting machine I or I' to cease running.

Once the cause of the stoppage of the machines S and Z has been remedied, to set the machines going again, the pushbutton of the microswitch P, as previously seen, has to be depressed in order to return the plant to its original operating condition.

What is claimed is:

1. A motor control and follow-up system for a packeting, overwrapping and packet parcelling plant, comprising;

first motor protection contactors to normally activate motors of a first unit of packeting machines for making packets of articles such as cigarettes;

a second motor protection contactor to normally deactivate a motor of a second unit of machines for overwrapping the packets in overwrapping material and for parcelling the overwrapped packets in cartons; a packet storage magazine unit, interposed between the first and second units of machines;

a main contactor having an operating coil and having a plurality of contacts for controlling the several motor protection contactors and the magazine unit to activate that unit and the first unit of machines when the main contactor is deenergized and to activate the first and second units of machines and deactivate the magazine unit when the main contactor is energized; and a circuit for selectively energizing and deenergizing the main contactor, comprising, normally closed control switches disposed in respective portions of the overwrapping and parcelling machines and in series with one another, means in the overwrapping and parcelling machines for opening one of the control switches upon any malfunction in one of the respective portions of those machines, an operating relay having a relay contact connected in series with the control switches, and a manually operable resetting pushbutton contact connected in series to the relay contact, the relay having an operating coil shunt connected to the series connection between the relay contact and the resetting pushbutton contact and being connected in series with the operating coil of the main contactor through a pair of the contacts of the main contactor, one of the contacts in the pair being normally open and the other, normally closed.

2. A system according to claim 1 including a synchronization contact in series with the operating coil of the relay and the pushbutton contact; and a cyclic cam rotatable by the overwrapping machine for cyclically opening and closing the synchronization contact.

3. A system according to claim 1 in which the manually operated pushbutton contact is normally open.

4. A system according to claim 1 including means for activating the motor protection contactors of the packeting machines and the overwrapping machine, comprising three pairs of contacts of the main contactor, two of the three pairs of contacts being normally open and the third pair being normally closed and the normally open contacts of one of the two pairs being common to the operating coils of the motor protection contactors of the packeting machines and the overwrapping machine.

5. A system according to claim 1 in which the magazine has switch means for deactivating the motors of the packeting machines when the magazine is filled with the packets.

* * * * *